US007800469B2

(12) United States Patent
Hallet

(10) Patent No.: US 7,800,469 B2
(45) Date of Patent: Sep. 21, 2010

(54) INDEXING UNIT AND CONTROL DEVICE COMPRISING SUCH AN INDEXING UNIT

(75) Inventor: Michel Hallet, Clinchamps-sur-Orne (FR)

(73) Assignee: Valeo Switches and Detection Systems-VSDS, Annemasse (FR)

( * ) Notice: Subject to any disclaimer, the term of this patent is extended or adjusted under 35 U.S.C. 154(b) by 10 days.

(21) Appl. No.: 11/995,963

(22) PCT Filed: Jul. 5, 2006

(86) PCT No.: PCT/FR2006/001632

§ 371 (c)(1),
(2), (4) Date: Jan. 17, 2008

(87) PCT Pub. No.: WO2007/010109

PCT Pub. Date: Jan. 25, 2007

(65) Prior Publication Data

US 2008/0210047 A1 Sep. 4, 2008

(30) Foreign Application Priority Data

Jul. 18, 2005 (FR) ..... 05 07611

(51) Int. Cl.
*G05G 1/08* (2006.01)
*G05G 5/06* (2006.01)
*H01H 19/00* (2006.01)
*H01H 21/00* (2006.01)

(52) U.S. Cl. ..... 335/205; 335/207; 335/306; 200/111 TW; 200/61.39; 200/336

(58) Field of Classification Search ..... 335/205–207; 200/11 TW, 61.39, 336
See application file for complete search history.

(56) References Cited

U.S. PATENT DOCUMENTS 3,597,714 A 8/1971 Brebbia et al.
6,922,123 B2 * 7/2005 Lalonde et al. ..... 335/207
7,465,890 B2 * 12/2008 Yamasaki et al. ..... 200/11 TW

FOREIGN PATENT DOCUMENTS

DE 90 03 955.6 7/1990
DE 202 20 379 U1 7/2003

OTHER PUBLICATIONS

PCT Search Report for PCT/FR2006/001632 (2 pages).

* cited by examiner

*Primary Examiner*—Ramon M Barrera
(74) *Attorney, Agent, or Firm*—Daly, Crowley, Mofford & Durkee, LLP

(57) ABSTRACT

The invention relates to a rotatable indexing unit for a manual control member (2), comprising two indexing components (31, 32) one of which is the rotor (32) rotatably secured to said control member and the other is the stator (31) which is embodied in such a way that it is fixedly maintained with respect to the rotor. The rotor and the stator are mounted coaxially and comprise a plurality of angular segments (317, 318, 327, 328) at least some of which are magnetised in such a way that they define stable and unstable positions for said control member, and the rotor and the stator have a conical or tapering shape which makes it possible to reduce the required radial space and increase the so-called active surfaces of interaction between the magnets.

18 Claims, 8 Drawing Sheets

Figure 1:
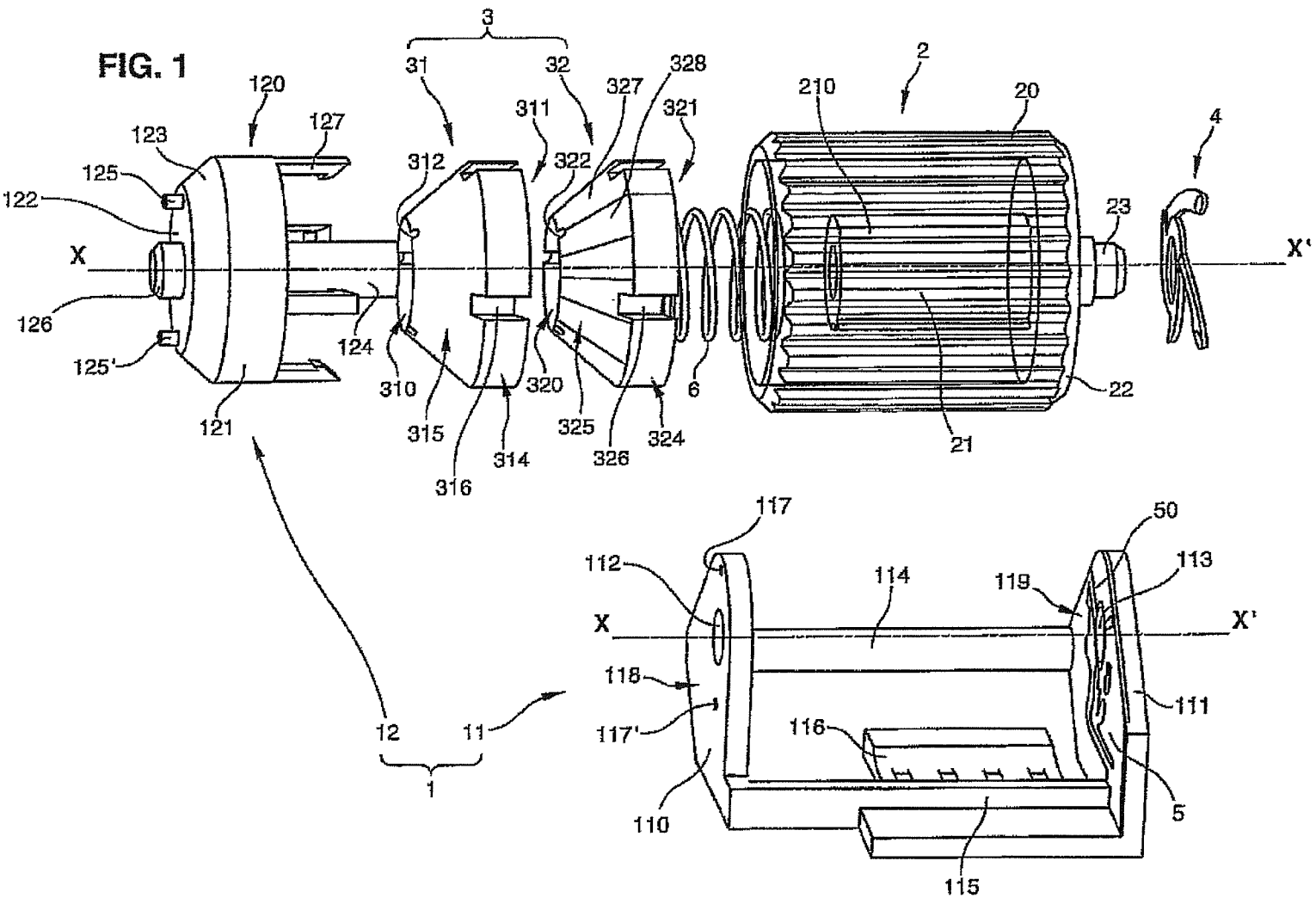

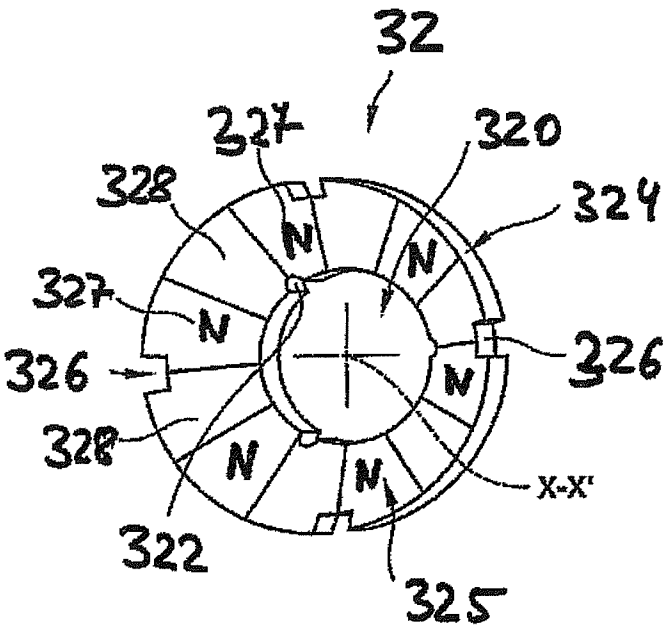
Fig 6.
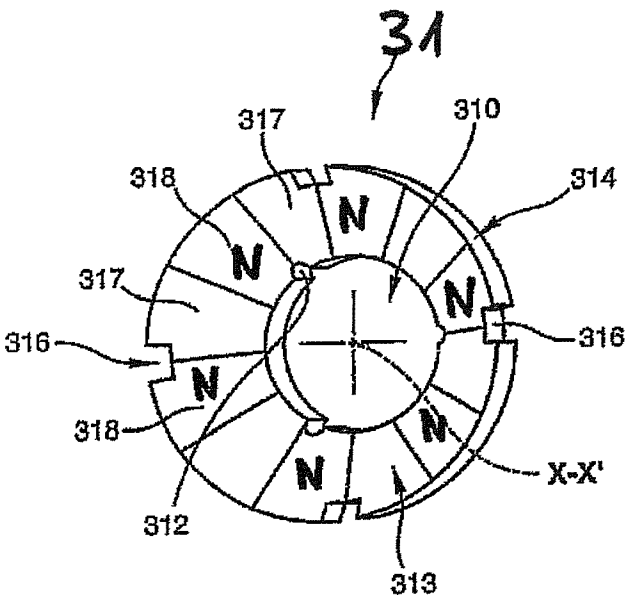

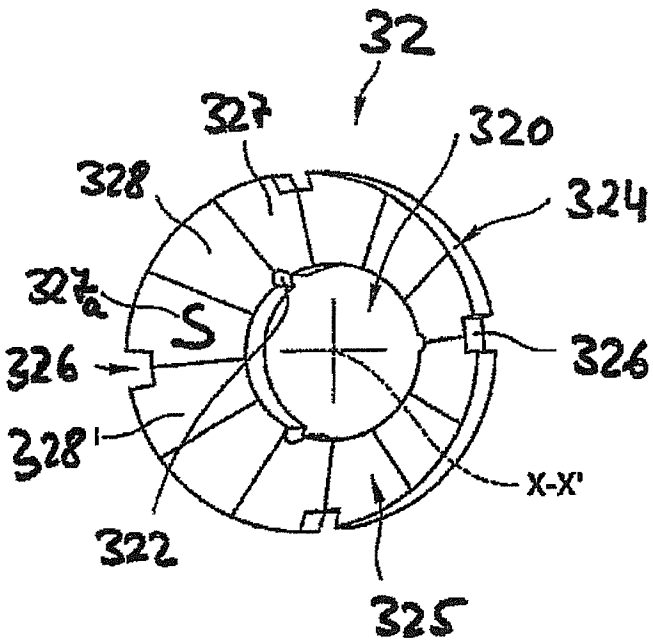
Fig 7
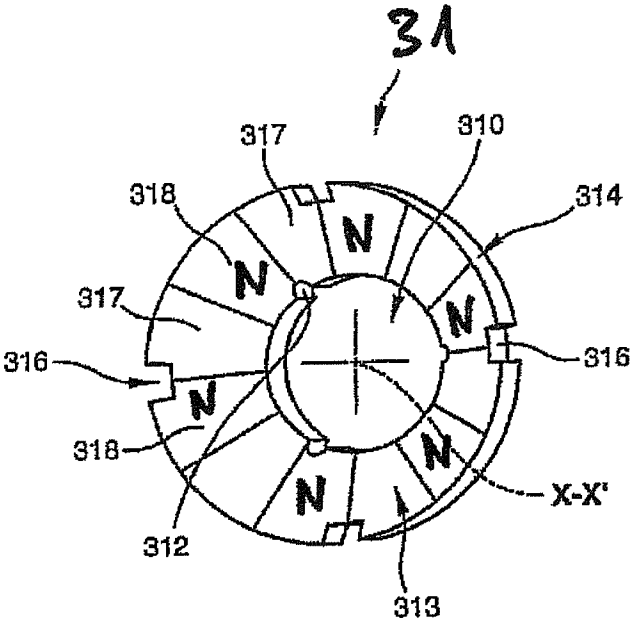

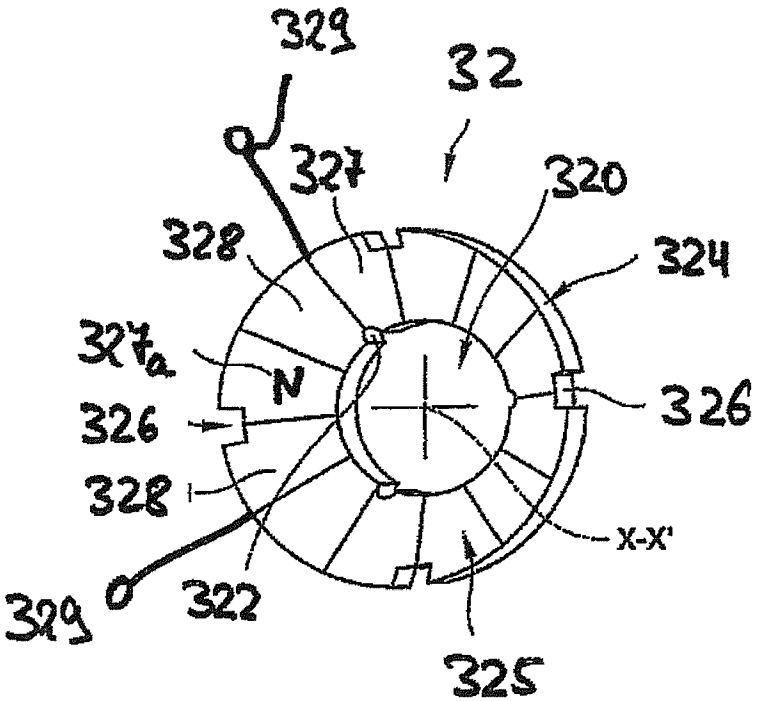
Fig 8
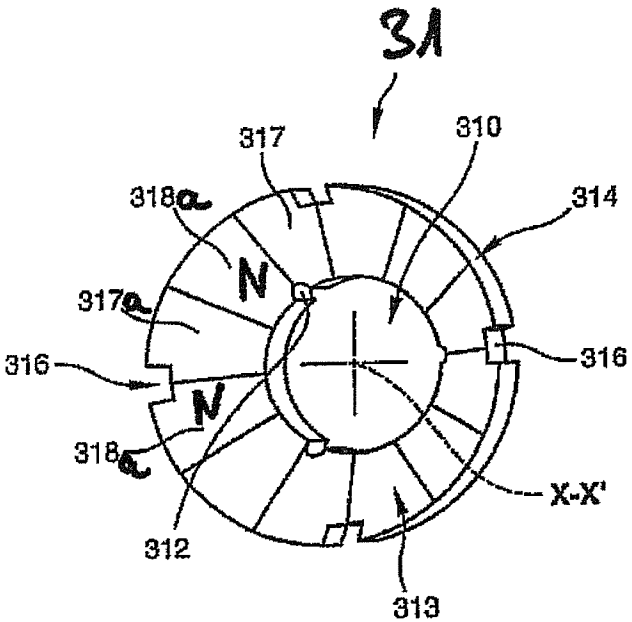

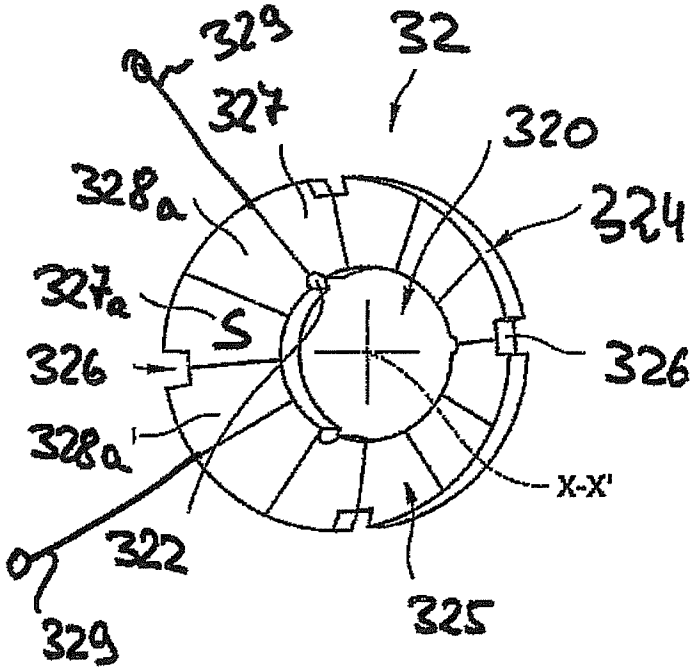
Fig 9
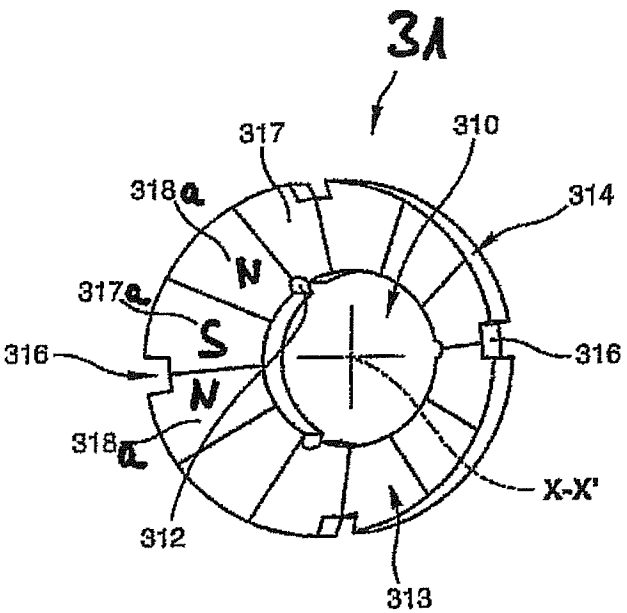

INDEXING UNIT AND CONTROL DEVICE COMPRISING SUCH AN INDEXING UNIT

CROSS REFERENCE TO RELATED APPLICATIONS

This application is a U.S. National stage application under 35 U.S.C. §371 of International Patent Application PCT/FR2006/001632, filed on Jul. 5, 2006 in the French Language which claims priority from FR application number 0507611, filed on Jul. 18, 2005.

The present invention relates to an indexing unit and a control device comprising such an indexing unit.

This indexing unit together with the control device are of particular application in the automobile industry, without, however, this being restrictive.

They can be used particularly on the dashboard of a vehicle for controlling the operation of the lights, rear-view mirrors, windshield wipers, radio or a multimedia device, for example.

A control device known in the state of the art generally comprises a manual control member whose operation by a user causes the activation of an electrical element or the displacement of a mechanical part, according to the different positions occupied by this member.

It is important that the user feels a tactile effect, e.g. by passing through a hard point, when he acts on this control member, so as to have the sensation that the operation has been properly performed. This effect is termed "indexing" the position of the control member.

Already known in the state of the art are control devices, such as microswitches or push-buttons, equipped with a spring, whose position is indexed on a notched ramp. However, in such devices the friction between the metal parts generally causes unwanted forces and their premature wear.

A device is also known according to the document FR-A-2 804 240, for controlling the electrical functions of an automotive vehicle, by magnetic switching.

This device comprises a housing, a rotary manual control member and means of indexing the position of this control member.

The means of indexing comprise an inner cylindrical ring, integral with the rotary control member and equipped on its outer periphery with several permanent magnets and an outer cylindrical ring, integral with the housing, also fitted with several magnets on its inner surface. The two rings are coaxially mounted, the magnets of the inner ring being located opposite those of the outer ring.

Such a device has the drawback that the two rings can be difficult to center with respect to one another and that the least offset of the rings may cause a malfunction or even jamming of the device.

In addition, it requires the manufacture of two magnetized parts with different structures.

Finally, the radial space requirement is high in order to achieve a great enough tactile effect.

The object of the invention is to solve the aforementioned drawbacks of the state of the art and to provide a control device whose means of indexing the different operating positions practically do not wear and thus keep a constant tactile feedback over time.

The invention also has the object of providing an indexing unit and a control device which have a reduced space requirement, which are simple in structure and cheap to manufacture and assemble.

For this purpose, the invention relates to a rotatable indexing unit for a manual control member, comprising two indexing components one of which is a rotor rotationally integral with said control member and a stator intended to be fixedly maintained with respect to the rotor, characterized in that the rotor and the stator are mounted coaxially and comprise a plurality of angular segments at least some of which are magnetized in such a way that they define stable and unstable positions for said control member, and in that the rotor and stator have a conical or tapering shape for reducing the radial space requirement and increasing the so-called "active" surfaces of interaction between the magnets.

The indexing unit may further include one of more of the following characteristics:

- the rotor and the stator each have angular segments with alternately opposite polarities,
- the rotor or the stator comprise angular segments of which only one segment out of two is magnetized with the same magnetic polarity,
- the magnetized angular segments of the stator and the rotor have the same magnetic polarity and the non-magnetized angular segments are smaller than the magnetized angular segments for defining stable positions more precisely.
- the magnetized angular segments of the stator have the same magnetic polarity and the angular segments of the rotor have the same polarity opposite to that of the stator in which the non-magnetized angular segments are larger than the magnetized angular segments for defining stable positions more precisely.
- one of the two, the stator or the rotor, comprises a single magnetized angular segment and the other of the two, the rotor or the stator, comprises angular segments having alternately opposite polarities or angular segments of which only one segment out of two is magnetized with the same magnetic polarity,
- for an indexing unit adapted for a pulse control member, the magnetization of the angular segments of the rotor and stator is carried out so as to define a stable rest position and one or two adjacent unstable positions, and the rotation of the rotor is limited mechanically to the level of the position of the unstable position or positions,
- the rotor and the stator are spaced apart from one another by an air gap e.
- the air gap e is produced by overmolding of a preferably non-stick covering on one or both indexing components.

The invention further relates to a control device for an element, particularly an electrical circuit or a mechanical member, comprising a fixed support, a rotary manual control member, means of indexing the position of this control member and means of activating said element which act upon it, according to the different positions occupied by said control member, characterized in that said means of indexing comprise an indexing unit as defined above and in that the stator is integral with the support and the rotor is rotationally integral with the rotary manual control member.

The device according to the invention may have one or more of the following characteristics:

- the rotor may slide axially with respect to this control member, along its rotation axis X-X', counter to the return force of elastically deformable means, in such a way that its active surface is parted from the active surface of the stator,
- the elastically deformable means are a helical spring, mounted around the rotation axis X-X' of the control member, integral at one of its extremities with the control member and at its other extremity with said mobile indexing component, this spring constantly tending to bring the rotor closer to the stator, the control member is made in the form of a rotary knurled wheel, a rotary control knob or a rotary end of a control lever with an internal rotation shaft bearing the rotor, the stator is kept fixed in a cylindrically shaped component acting as a bearing for the control member.

Other characteristics and advantages of the invention will appear from the description which will now be given, with reference to the accompanying drawings showing a possible mode of embodiment of it given as a non-restrictive guide.

Figure 2:
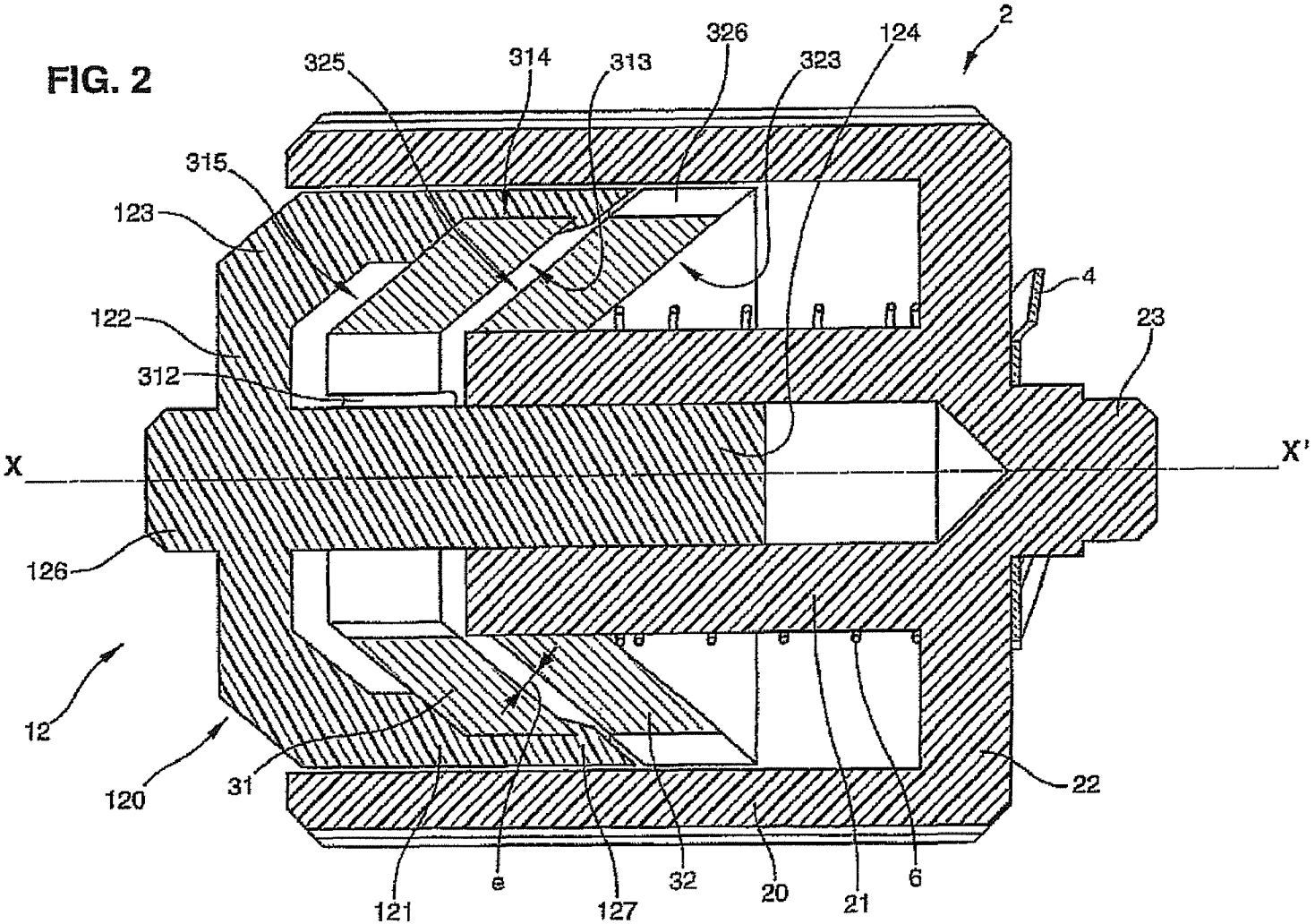
Figure 3:
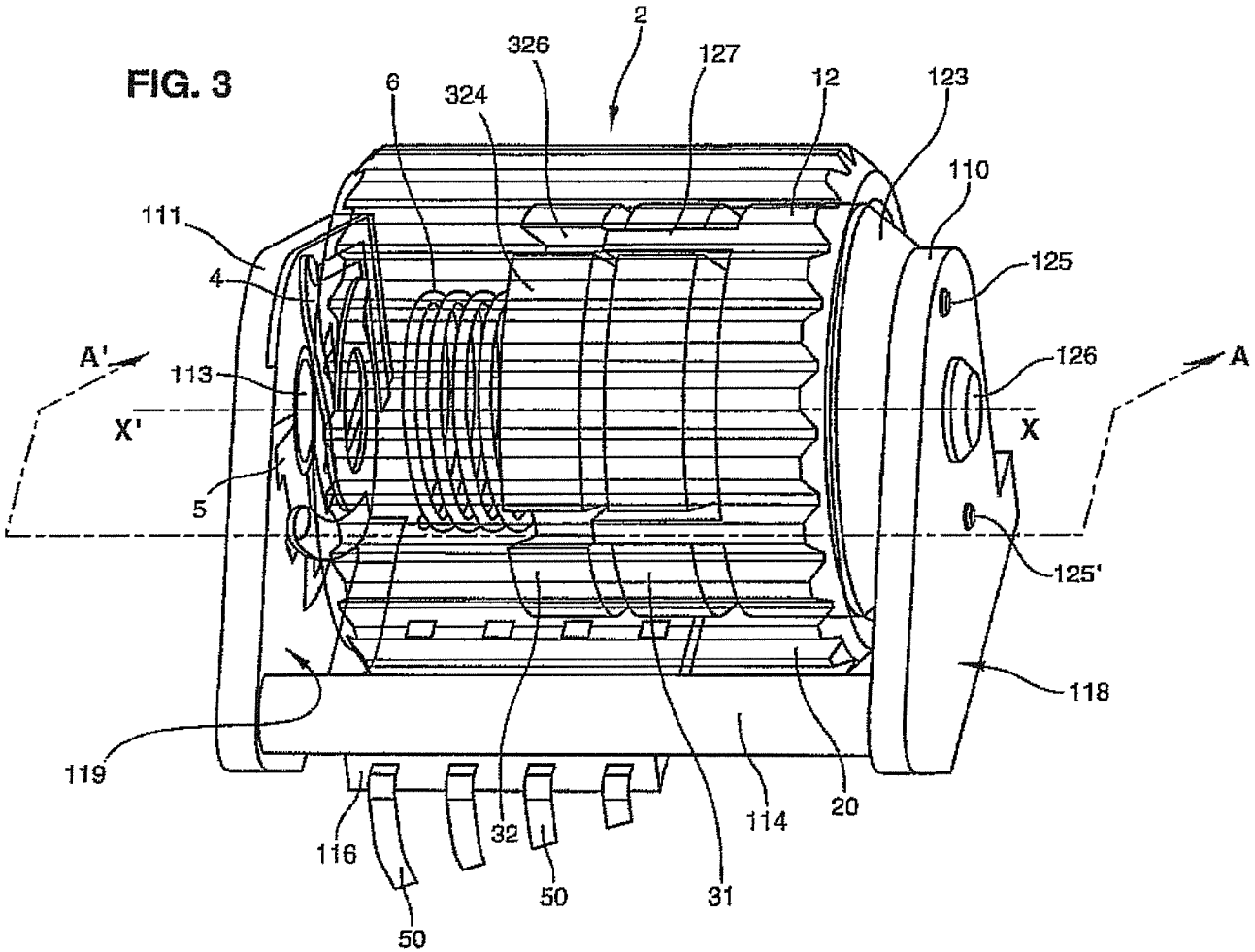
Figure 5:
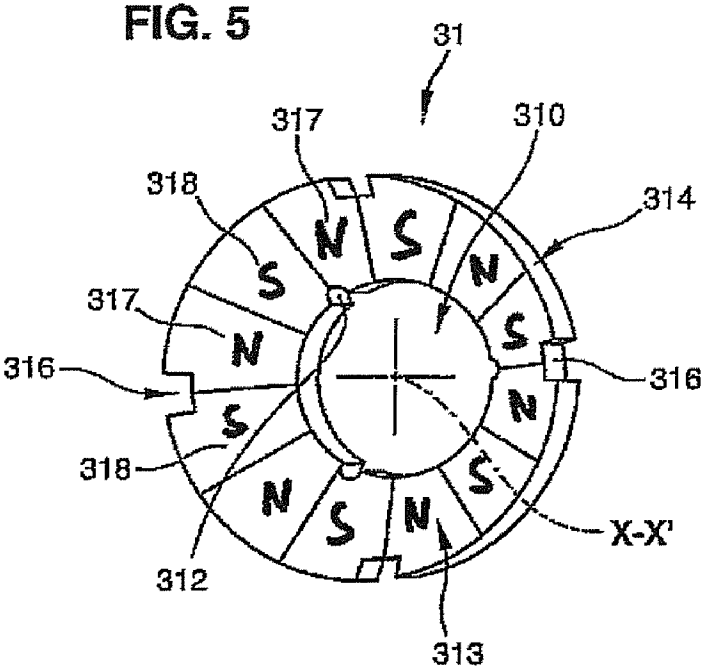
Figure 4:
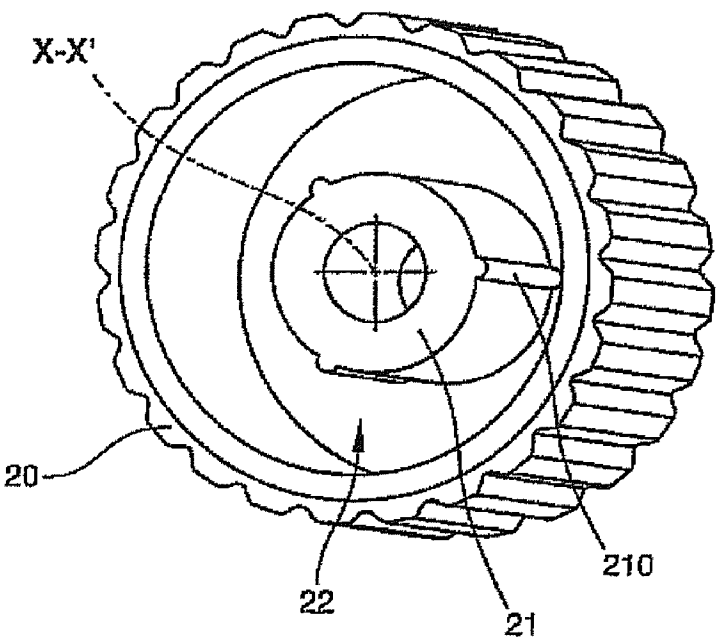

In these drawings:

FIG. 1 is an exploded perspective view of a mode of embodiment of the control device according to the invention, FIG. 2 is an axial section view of a part of the control device, taken along the sectional plane passing through the line A-A' in FIG. 3, FIG. 3 is a perspective view of the device in FIG. 1, in which the various component elements are in an assembled position, the control member being partially and transparently represented for reasons of clarity, FIG. 4 is a perspective view of the interior of said control member, and FIG. 5 is a perspective view of the interior of one of the two indexing components of the device, FIG. 6 is a perspective view of the interior of one of the two indexing components of the device according to a variant, FIG. 7 is a perspective view of the interior of the two indexing components of the device according to another variant, FIG. 8 is a perspective view of the interior of the two indexing components of the device according to another so-called "pulse" variant, FIG. 9 is a perspective view of the interior of the two indexing components of the device according to another so-called "bistable" variant, By referring to FIG. 1, it can be seen that the control device comprises a support 1 in two parts, a rotary manual control member 2, a unit for indexing 3 the position of this member 2 and means of activation 4 of an element 5.

In the mode of embodiment described here, the element to be controlled 5 is an electrical circuit and its means of activation 4 consist of a mobile electrical contact, with several fins, or sliding contact.

The various component elements of this device will now be described in more detail.

The support 1 comprises a main part 11 and a secondary part 12 in the form of a cover.

The main part 11 is intended to be fixed onto the dashboard of an automotive vehicle, for example. It therefore has a fixed reference for the control.

According to other variants not shown, provision is made for this main part 11 to be fixed onto the vehicle's steering wheel, e.g. on a branch of the steering wheel, on the bearing or on a branch of the controls around the steering wheel, e.g. a remote radio control.

The main part 11 comprises two parallel flanges 110 and 111, each of them being pierced by a hole 112, 113, respectively. These holes 112 and 113 are aligned along a longitudinal axis X-X'.

The two flanges 110 and 111 are connected together by two longitudinal bars 114, 115 forming a spacer. These two bars 114 and 115 are perpendicular to the plane of the two flanges 110 and 111 and extend parallel to the axis X-X'.

In addition, the flange 110 is traversed right through by two drillings 117, 117', diametrically opposite with respect to the hole 112. Their role will be described later.

The electrical circuit 5 is fitted on the inner surface 119 of the flange 111, i.e. the surface facing in the direction of the flange 110.

The longitudinal bar 115 further comprises a connecting bracket 116, containing the ends of the conducting strips 50 of the electrical circuit 5. This connecting bracket 116 is best shown in FIG. 3. It is used to connect the electrical circuit 5 to its supply on the one hand and to the devices to be activated on the other, such as the lights, a radio or the windshield wipers, for example.

The secondary part 12 will now be described together with FIGS. 1 and 2.

It comprises a concave socket 120, composed of a cylindrical part 121 closed off by a base 122.

The area situated at the intersection between the cylindrical part 121 and the base 122 is beveled and bears the numerical reference 123.

The secondary part 12 further comprises a center rod 124, which extends perpendicularly to the base 122, inside the concave socket 120.

A centering pin 126 projects towards the outside, from the base 122. It is located in the extended axis of the rod 124.

In addition, the cylindrical part 121 comprises several detent catches 127, numbering four in this mode of embodiment. These catches 127 extend from the rim of the concave socket 120, in the opposite direction to the base 122, parallel to the rod 124.

In preference, the secondary part 12 is made of a flexible material, e.g. plastic, so that the detent catches 127 have some flexibility.

Finally, two nipples 125, 125' project towards the outside, from the base 122. They are diametrically opposite with respect to the centering pin 126.

When the secondary part 12 is fitted inside the main part 11, the centering pin 126 is housed inside the hole 112 of the flange 110 and the two nipples 125, 125', inside the two drillings 117, 117', respectively. As can be seen in FIG. 3, in the assembled position, the nipples 125, 125' and the pin 126 project outside the outer surface 118 of the flange 110.

In this position, the secondary part 12 is therefore integral with the fixed main part 11 and the rod 124 extends along the longitudinal axis X-X'.

In the mode of embodiment described here, the rotary manual control member 2 has the form of a knurled wheel. It will now be described in more detail referring to FIGS. 1, 2 and 4.

The control member 2 comprises an outer cylindrical sleeve 20, closed off at one of its extremities by a circular base 22. The longitudinal axis of the sleeve 20 is coaxial with the axis X-X' of the main part 11, when all the elements of the control device are assembled.

The control member also comprises an inner cylindrical sleeve 21, coaxial with the outer sleeve 20 and which extends inside it, from the base 22. This inner sleeve 21 is of a shorter length than the outer sleeve 20.

A spindle 23 projects towards the outside, from the base 22. It extends along the axis X-X'. In the assembled position, this spindle 23 is housed inside the hole 113 of the flange 111.

In preference, the outer surface of the sleeve 20 is notched, so as to improve gripping by the user.

Finally, the inner sleeve 21 has on its outer surface, longitudinal ribs 210, here numbering three, which extend parallel to the axis X-X'. These ribs 210 appear best in FIG. 4.

As can be seen by referring to FIG. 2, the dimensions of the secondary part 12 and of the control member 2 are such that the outer diameter of the cylindrical part 121 of the socket 12 is very slightly less than the inner diameter of the sleeve 20 so as to be able to act as a bearing. In addition, the diameter of the rod 124 substantially corresponds to the inner diameter of the inner sleeve 21 with a slight clearance.

Thus, when the secondary part 12 and the control member 2 are assembled, the rod 124 partially penetrates inside the inner sleeve 21, so as to ensure the rotational guidance of the member 2 with respect to this secondary part 12.

A user may turn the control member 2 with respect to said secondary part 12, around the axis X-X' which constitutes its rotation axis.

The unit for indexing 3 the position of the control member 2 comprises two indexing components, a rotor 32 and a stator 31. These two components have an identical structure, only their magnetization may differ.

In a first example of embodiment, only the component 31, the stator, will be described in detail, referring to FIGS. 1, 2 and 5. The different constituent parts of the rotor 32 which are identical to the component 31 bear the same numerical references, but start with the prefix 32.

The stator 31 has a generally tapering shape and possesses a certain thickness. Accordingly, it includes a circular, large diameter opening 311 and a smaller diameter, cylindrically shaped opening 310.

On its inner cylindrical wall, the opening 310 has three longitudinal grooves 312, parallel to the axis of revolution X-X' of the tapering component, as can be seen in FIG. 5.

The inner tapering surface of the component 31 bears the reference 313.

The outer surface of the tapering component 31 comprises a cylindrical part 314 and a tapering part 315.

Finally, as can be seen in FIGS. 1 and 5, four longitudinal slots 316 are arranged within the thickness of the largest diameter part of the component 31 and open onto the cylindrical surface 314 and onto a part of the tapering surface 315, located nearby. They are parallel to the axis of revolution X-X' of the component 31.

The inner tapering surface 313 of the indexing component 31 is magnetized. Hereafter this is referred to as the "hollow active surface".

Referring to FIG. 5, it can be seen that it comprises a plurality of magnetized angular segments 317, 318 whose polarities are alternately opposite. In other words, a magnetized angular segment 317 of "North" polarity is inserted between two magnetized angular segments 318 of "South" polarity. The references "N" for "North" pole and "S" for "South" pole have been assigned to each angular segment.

Conversely, the outer tapering surface 325, of the indexing component 32, called the "projecting active surface", comprises a plurality of magnetized angular segments 327, 328, whose polarities are also alternately opposite with "N" and "S" polarities.

The magnetized segments can be separate elements, stuck onto the indexing components 31, 32 or integrated into them, e.g. by overmolding. They may also be magnetic elements with segments, obtained by a process of sintering.

Since the two indexing components 31 and 32 are of identical dimensions, the hollow active surface 313 of the component 31 is of a complementary shape to the projecting active surface 325 of the indexing component 32. It is further noted that the active surface is of a larger dimension than that which would be obtained by a radial arrangement.

These two indexing components are assembled as shown in FIG. 2.

The indexing component 31 is fixedly and integrally mounted with the secondary part 12 of the support 1, by detent. It is arranged inside this secondary part 12, so that the detent catches 127 enter into the slots 316.

The internal diameter of the opening 310 is clearly larger than that of the external diameter of the rod 124, such that this can penetrate inside the indexing component 31.

Furthermore, the component 32 is mounted around the inner sleeve 21 of the member 2, so that its grooves 322 cooperate with the longitudinal ribs 210 of this sleeve 21.

This set-up ensures the rotational interlocking of the indexing component 32 with the control member 2, while allowing its free axial translation, over a limited travel, with respect to the inner sleeve 21.

When they are assembled, the axes of revolution of the two indexing components 31 and 32 are coaxial with the rotation axis X-X' of the control member 2.

In addition, a helical spring 6 is fitted around the inner sleeve 21. One of its extremities abuts against the base 22 of the member 2, while its opposite extremity rests on the inner tapering surface 323 of the indexing component 32.

This spring 6 constantly tends to displace the indexing component 32 in the direction of the component 31.

The sliding contact 4 is rotationally integral with the manual control member 2. It is fixed around the spindle 23 and projects outwards, from the base 22, so as to rub against the conducting strips of the electrical circuit 5.

The operation of the device will now be described in more detail.

In the initial, stable, rest position, illustrated in FIG. 2, the magnetized active surfaces 313 and 325 are spaced apart from one another by an air gap e. The north poles of the indexing component 31 magnets are opposite the south poles of the indexing component 32 magnets.

The sliding contact 4 is in a given position with respect to the electrical circuit 5 strips and the signal delivered by the latter corresponds to a first state. By way of a purely illustrative example, if this device is used to control an automotive vehicle's lights, these lights may be turned off for example.

When the user wishes to activate the circuit 5, he turns the control member 2. The north poles of the disk 32 transitionally pass into a position in which they are located opposite the north poles of the indexing component 31. The magnetic fields are repelled and this position is unstable.

In this position, the indexing component 32 recoils very slightly, sliding along the sleeve 21, and slightly compressing the spring 6.

When angular segments of the same polarity of the two indexing components 31 and 32 are opposite each other and are repelled, the operator feels a resistance and the passage of a hard point.

When the operator continues with the rotation movement of the member 2, the indexing component 32 passes into the next stable position, in which its north pole magnetized segments are opposite the south poles of those of the indexing component 31. The magnets are attracted to each other and the component 32 slides along the axis X-X', in the direction of the component 31, assisted in this by the return force of the helical spring 6.

The operator feels that he has gone past a hard point and has the tactile sensation that the displacement of the member 2 has been properly performed.

In addition, the sliding contact 4 has changed position with respect to the electrical circuit 5 conducting strips and the signal delivered by the latter corresponds to a second state, different from the first. In the aforementioned example, the automotive vehicle's lights are then lit.

The number of magnetized angular segments is adapted to the number of different positions that may be selected using the control member 2.

According to a variant embodiment not shown in the figures, the magnetized angular segments may be provided on only one portion of the tapering active surfaces 313, 325, the number of positions capable of being occupied by the control member 2 then being limited accordingly.

Setting the width of the air gap e between the two indexing components 31 and 32 can be used to modulate the force of attraction of the magnets and thus adapt the amount of effort that the operator must exert on the control member 2 to turn it.

The air gap e is obtained by an extra thickness of molding on one of the two indexing components 31, 32.

Finally, it will be observed that other variant embodiments of the invention may be envisaged.

Thus, the two indexing components 31 and 32 could have a conical shape instead of a tapering one.

Referring to FIG. 6, a variant of the indexing unit may consist of one where the magnetization of the indexing components is "reduced".

Thus it can be arranged that for the component 31 only the segments 318 are magnetized for example by a "North" pole, the segments 317 remaining "magnetically" neutral and, similarly, on the component 32, only the segments 327 are magnetized for example by a "North" pole. This variant has an advantage in terms of cost, given that only half of the segments forming the active surface are magnetized.

In this variant, the stable position will be defined when a "North" pole is facing a non-magnetized segment.

Of course, it can also be arranged that the segments 327 are for example magnetized by a "South" pole, and then the stable position will be defined when a "South" pole faces a "North" pole, and the positions in which the neutral segments of the components 31 and 32 will face each other correspond to unstable positions.

According to the variant in FIG. 7, it can be arranged that for the component 31 only the segments 318 are magnetized for example by a "North" pole, the segments 317 remaining "magnetically" neutral and, that on the component 32, only one segment 327*a* is magnetized for example by a "South" pole.

Thus the component 32 may be made entirely of plastic with a single magnetic segment affixed for example by gluing.

FIG. 8 shows an arrangement of the components 31 and 32 for creating a pulse control, which can for example be used for shifting up or down the gears of a semi-automatic gearbox, the radio stations of a radio satellite, or increasing or decreasing the speed set value of a cruise control system.

According to this example, the component 31 has two segments 318*a* magnetized by a "North" pole with one segment 317*a* either magnetically neutral, or having a "South" magnetization corresponding to the rest position. The other segments 317 and 318 are not magnetized.

The component 32 has a magnetized segment 327*a* and its rotation with respect to the component 31 is mechanically limited, for example by stops 329 shown schematically, such that the "North" pole 327*a* can only be displaced by being above the segments 318*a* and 317*a*.

Thus, an indexing unit has been created with two unstable control positions preferably corresponding to a position of the sliding contact 4 establishing an electrical contact so as to form a so-called "pulse" signal for increasing or decreasing a parameter of a control module and a stable position of rest in the middle and a stable median position preferably corresponding to a position of the sliding contact 4 not establishing any electrical contact.

In this configuration, the knurled wheel returns automatically into its neutral position after a pulse has been created, this being exploitable by any suitable processing unit.

The variant in FIG. 9 is distinguished from that in FIG. 8 solely by the fact that the segment 327*a* has a "South" pole magnetization instead of a "North" pole.

Thus, a bistable indexing unit has been created, since only the two positions where the "South" pole of the segment 327*a* is above one of the "North" poles of the segments 318*a*, are stable positions.

This bistable indexing unit is suitable, for example, for a command for starting up or shutting down the cruise control.

In addition, for a better definition of stable and unstable positions, in particular when only one part of the segments is magnetized, the other part remaining neutral, it is arranged that the segments have a different angular extent.

Thus, by providing less wide "neutral" segments, for example half as wide as the magnetized segments, the stable position can be defined more precisely.

The indexing component 31 could also be made of a piece with the secondary component 12 of the support 1.

The electrical circuit 5 could, for example, be replaced by a mechanical member and the sliding contact 4, by a control pin, whose rotation would lead to the displacement of the aforesaid mechanical member.

Finally, the support 1 and in particular its main part 11 could have a different form. The spindle 23 and the flange 111 could be eliminated and the sliding contact 4 and the circuit 5 arranged elsewhere, so that the user may have access to the base 22 of the control member 2. The control member 2 then appears in the form of a knurled control wheel, of the kind used to control a radio inside an automotive vehicle.

The control device that has just been described has a number of advantages over prior art devices.

The tapering shape of the indexing components 31 and 32 enables these components to be self-aligned and to be able to increase the area of the magnetized surfaces and therefore the rotation movement torque, without increasing the diameter of the components 31, 32.

In addition, since the indexing component 32 is mobile in axial translation, this enables a recoil movement to be kept between the magnetized active surfaces 313, 325, and the adjustment of the force/displacement curve.

The present invention is not limited to a construction with a support 11. In fact, the configuration described above for achieving indexing with two tapering magnetized components has a small space requirement and enables simple and easy integration into a control lever, e.g. for the lights or windshield wipers of an automotive vehicle.

The present invention has been described with rotary indexing for a knurled control wheel.

Of course, the present invention can also be applied to a rotary control knob, e.g. for multi-function and navigation commands in an automotive vehicle. In this case also, the small radial space requirement of the present indexing mechanism with two tapering components enables one of the two tapering components to be easily housed in the knob even while the other component is held by the knob support.

The invention claimed is:

1. A rotatable indexing unit for a manual control member, the unit comprising:

two indexing components one of which is a rotor rotationally integral with the control member and one of which is a stator configured to be fixedly maintained with respect to the rotor, characterized in that the rotor and the stator are mounted coaxially and comprise a plurality of angular segments at least some of which are magnetized in such a way that that they define stable and unstable positions for the control member, and in that said rotor and said stator have one of a conical shape or tapering shape.

2. The unit as claimed in claim 1, characterized in that said rotor and said stator each have angular segments with alternately opposite polarities.

3. The unit as claimed in claim 1, characterized in that said rotor or said stator comprises a plurality of angular segments and wherein alternating ones of said plurality of angular segments are magnetized with the same magnetic polarity.

4. The unit as claimed in claim 3, characterized in that the at least some of the plurality of angular segments are non-magnetized and wherein the magnetized angular segments of said stator and said rotor have the same magnetic polarity and wherein the non-magnetized angular segments are smaller than the magnetized angular segments.

5. The unit as claimed in claim 3, characterized in that the magnetized angular segments of said stator have the same magnetic polarity and in that the angular segments of said rotor have the same polarity and which is opposite to that of the magnetic polarity of the angular segments of said stator and wherein the non-magnetized angular segments of said stator and said rotor are larger than the magnetized angular segments.

6. The unit as claimed in claim 1, characterized in that one of said stator or said rotor, comprises a single magnetized angular segment and in that the other of said rotor or said stator, comprises angular segments having alternately opposite polarities or angular segments of which only alternating segments are magnetized with the same magnetic polarity.

7. The indexing unit as claimed in claim 1, adapted for an impulse control member, characterized in that the magnetization of the angular segments of said rotor and said stator is carried out so as to define a stable rest position and one or two adjacent unstable positions, and in that the rotation of said rotor is limited mechanically to the level of the position of the unstable position or positions.

8. The unit as claimed in claim 1, characterized in that an outer surface of said rotor and an inner surface of said stator are spaced apart from one another by an air gap e.

9. The unit as claimed in claim 8, characterized in that a covering disposed on one or both of said stator and said rotor produces the air gap e.

10. The device as claimed in claim 1 wherein the shape of said rotor and stator is selected so as to reduce a radial space requirement and to increase an amount of active surfaces of interaction between the magnets.

11. The unit as claimed in claim 1 characterized in that an outer surface of said rotor and an inner surface of said stator are spaced apart from one another by an air gap e.

12. A control device for an element, said control device comprising:

a fixed support;

a rotary manual control member;

means of indexing the position of said control member; and means of activating the element which act upon it, according to the different positions occupied by said control member, characterized in that said means of indexing includes an indexing unit having a stator which is integral with the support and a rotor which is rotationally integral with the rotary manual control member, wherein the indexing unit corresponds to a rotatable indexing unit for a manual control member, the rotatable indexing unit comprising:

two indexing components one of which is said rotor rotationally integral with said control member and one of which is said stator configured intended to be fixedly maintained with respect to the rotor, the rotor and the stator are mounted coaxially and comprise a plurality of angular segments at least some of which are magnetized in such a way that they define stable and unstable positions for said the control member, and in that the said rotor and said stator have one of a conical shape or tapering shape for reducing the radial space requirement and increasing so-called active surfaces of interaction between the magnetized angular segments.

13. The control device as claimed in claim 12 characterized in that said rotor has a rotation axis X-X' and wherein said rotor is configured to slide axially with respect to said control member, along the rotation axis X-X', counter to the backward force of an elastically deformable means, in such a way that an active surface of said rotor is parted from an active surface of said stator.

14. The control device as claimed in claim 13, characterized in that the elastically deformable means comprises a spring, mounted around the rotation axis X-X' of the control member, integral at a first one of its extremities with the control member and at a second one of its extremities with said means for indexing.

15. A device as claimed in claim 14, characterized in that the control member is provided as one of: a rotary knurled wheel, a rotary control knob or a rotary end of a control lever with an internal rotation shaft bearing the rotor.

16. A device as claimed in claim 15, characterized in that said stator is kept fixed in a cylindrically shaped component acting as a bearing for the control member.

17. The device as claimed in claim 14 wherein said spring is disposed such that it provides a force which tends to bring the rotor closer to the stator.

18. The device as claimed in claim 14 wherein said spring is provided having a helical shape.

* * * * *